United States Patent [19]

Miyaki et al.

[11] Patent Number: 4,499,883

[45] Date of Patent: Feb. 19, 1985

[54] DISTRIBUTOR TYPE FUEL-INJECTION PUMP FOR DISTRIBUTING FUEL TO CYLINDERS OF AN INTERNAL COMBUSTION ENGINE

[75] Inventors: Masahiko Miyaki, Oobu; Akira Masuda; Toshimi Matsumura, both of Aichi, all of Japan

[73] Assignee: Nippondenso Co., Ltd., Kariya, Japan

[21] Appl. No.: 564,408

[22] Filed: Dec. 22, 1983

[30] Foreign Application Priority Data

Dec. 26, 1982 [JP] Japan ..... 57-228567

[51] Int. Cl.[3] ..... F04B 19/00

[52] U.S. Cl. ..... 123/503; 123/450; 123/500; 417/289

[58] Field of Search ..... 123/503, 450, 500, 449; 417/462, 289

[56] References Cited

U.S. PATENT DOCUMENTS

| | | | |
|---|---|---|---|
| 2,813,523 | 11/1957 | Bischoff | 417/289 |
| 2,935,062 | 5/1960 | Aldinger et al. | 123/450 |
| 3,752,138 | 8/1973 | Gaines | 123/450 |
| 4,362,141 | 12/1982 | Mowbray | 123/450 |
| 4,367,714 | 1/1983 | Di Domenico et al. | 123/500 |
| 4,441,474 | 4/1984 | Garrett et al. | 123/503 |

FOREIGN PATENT DOCUMENTS

| | | | |
|---|---|---|---|
| 2058947 | 4/1981 | United Kingdom | 123/503 |

*Primary Examiner*—Magdalen Y. C. Moy

*Attorney, Agent, or Firm*—Cushman, Darby & Cushman

[57] ABSTRACT

A distributor type fuel-injection pump according to the present invention is provided with a rotor which is rotated by an engine. The rotor has a pair of plungers slidable in the radial direction of the rotor, and a fuel pumping chamber is defined between the plungers. The rotor is surrounded by a cam ring which reciprocates the plungers as the rotor rotates, thereby sucking fuel into the fuel pumping chamber and pressurizing the fuel therein. The fuel pressurized in the fuel pumping chamber is distributed to individual cylinders of the engine. A plurality of spill holes are formed in the rotor, communicating with the fuel pumping chamber and opening to the outer peripheral surface of the rotor. A control sleeve to open and close the spill holes is axially slidably fitted on the rotor. First and second spill grooves capable of communicating with the spill holes are formed on the inner peripheral surface of the control sleeve. The first and second spill grooves open or close the spill holes to define the timing for the start of fuel delivery in the fuel pumping chamber and the timing for the end of fuel delivery, thereby determining the amount of fuel delivery.

8 Claims, 9 Drawing Figures

DISTRIBUTOR TYPE FUEL-INJECTION PUMP FOR DISTRIBUTING FUEL TO CYLINDERS OF AN INTERNAL COMBUSTION ENGINE

BACKGROUND OF THE INVENTION

The present invention relates to a distributor type fuel-injection pump for distributing fuel to individual cylinders of an internal combustion engine, and more specifically to a distributor type fuel-injection pump provided with a rotor capable of pumping and distribution by only rotating.

A distributor type fuel-injection pump of this kind is disclosed in U.S. Pat. No. 2,935,062. This fuel-injection pump has a drive shaft (equivalent to the rotor) which is rotated by an engine. A cylindrical bore is formed in the drive shaft, extending at right angles to the axis of the drive shaft. A pair of pistons are slidably fitted in the cylindrical bore. Opposed end faces of the pistons define a fuel pumping chamber in the cylindrical bore. As the drive shaft rotates, the pistons are reciprocated by the action of cam means at a frequency equivalent to the number of the engine cylinders for each revolution of the drive shaft.

A cutout defining a control surface portion is formed on the outer peripheral surface of the drive shaft. The cutout is connected to the fuel pumping chamber by means of an inlet passage formed in the drive shaft. A control sleeve covering the cutout is axially slidably fitted on the outer surface of the drive shaft. Radial openings as many as the engine cylinders are formed in the control sleeve, arranged at regular intervals around the axis of the control sleeve. As the drive shaft rotates, the radial openings can communicate with the inlet passage by means of the cutout.

An outlet passage communicating with the fuel pumping chamber and a radial passage connecting with the outlet passage, the radial passage serving to distribute fuel to the individual engine cylinders, are formed in the drive shaft.

The operation of the aforementioned fuel-injection pump will now be described in brief. As the drive shaft rotates, the pistons are reciprocated, and the opening and closing of the inlet passage are controlled by the radial openings of the control sleeve and the control surface portion of the drive shaft. As the inlet passage is opened and closed and as the piston reciprocates, the fuel is fed through the inlet passage into the fuel pumping chamber, and is pressurized therein. The pressurized fuel is distributed to the individual engine cylinders through the outlet passage and the radial passage. The amount of fuel delivered from the fuel-injection pump depends on the closure time of the inlet passage, that is, the time of fuel pressurization in the fuel pumping chamber, after the fuel is fed through the inlet passage into the fuel delivery is decided by the unique shape of the control surface portion of the drive shaft and the axial position of the radial openings of the control sleeve.

This conventional fuel-injection pump is subject to the following drawback. Since the amount of fuel delivery depends on the shape of the control surface portion as a principal factor, the control surface portion need be worked with high accuracy for high-accuracy control of the amount of fuel delivery. However, it is technically difficult to accurately fabricate the control surface portion of the unique shape on part of the outer peripheral surface of the drive shaft. Also, the fabrication of the control surface portion requires higher cost.

SUMMARY OF THE INVENTION

The object of the present invention is to provide a distributor type fuel-injection pump for an internal combustion engine having a structure simple and easy to work and capable of controlling the amount of fuel delivery with high accuracy.

According to the invention, there is provided a distributor type fuel-injection pump for distributing fuel to individual cylinders of an internal combustion engine, which comprises a housing, a rotor disposed in the housing and rotated by the engine, the rotor having therein a cylindrical bore extending at right angles to the axis of the rotor, a fuel passage opening into the cylindrical bore and extending along the axis of the rotor, and spill holes as many as the engine cylinders, communicating with the fuel passage and opening circumferentially arranged at regular intervals on the outer peripheral surface of the rotor, a pair of plungers slidably fitted in the cylindrical bore of the rotor, opposed end faces of the plungers defining a fuel pumping chamber in the cylindrical bore, fuel supply means for supplying fuel to the fuel pumping chamber, cam means engaging the two plungers in the housing, the cam means being adapted to reciprocate both of the plungers in the cylindrical bore as the rotor rotates, whereby a fuel pressurization process is repeated at a frequency equivalent to the number of the engine cylinders for each revolution of the rotor, distribution/delivery means for distributing and delivering the fuel pressurized in the fuel pumping chamber to the individual engine cylinders through the fuel passage, the distribution/delivery means including a control sleeve fitted on the outer peripheral surface of the rotor so as to be able to slide along the axis of the rotor, the control sleeve having on the inner peripheral surface thereof first and second spill grooves capable of communicating with each of the spill holes, at least one end of each of the spill grooves opening to the outer side face of the control sleeve, the circumferential distance between the first and second spill grooves varying along the axis of the rotor, whereby the opening and closing of the spill holes in each fuel pressurization process are controlled by the first and second spill grooves, so that the timing for the start of fuel delivery and the timing for the end of fuel delivery, which define the amount of fuel delivery, are determined in each fuel pressurization process, and adjusting means for moving the control sleeve along the axis of the rotor to adjust the amount of fuel delivery.

According to the invention, the amount of fuel delivery can be defined by the first and second spill grooves formed on the inner peripheral surface of the control sleeve. Thus, the structure for controlling the amount of fuel delivery is simplified. Since the first and second spill grooves are simple in shape, they can easily be worked with high accuracy. The existence of the first and second spill grooves never leads to an increase of the space for the fuel pressurization, including the fuel pumping chamber, the fuel passage, etc., at the time of the fuel pressurization. Thus, the fuel can be delivered pressurized to high pressure.

According to one aspect of the invention, the first and second spill grooves have their openings on both side faces of the control sleeve, so that they can further easily be worked, permitting a reduction in working cost.

According to another aspect of the invention, the cam means includes a cam ring which surrounds the rotor and whose inner peripheral surface serves as a cam face, and turning means is provided for directly turning the cam ring around the axis of the rotor. Thus, the timing for the start of the fuel pressurization can accurately be adjusted.

DETAILED DESCRIPTION OF THE PREFERRED EMBODIMENTS

Figure 1:
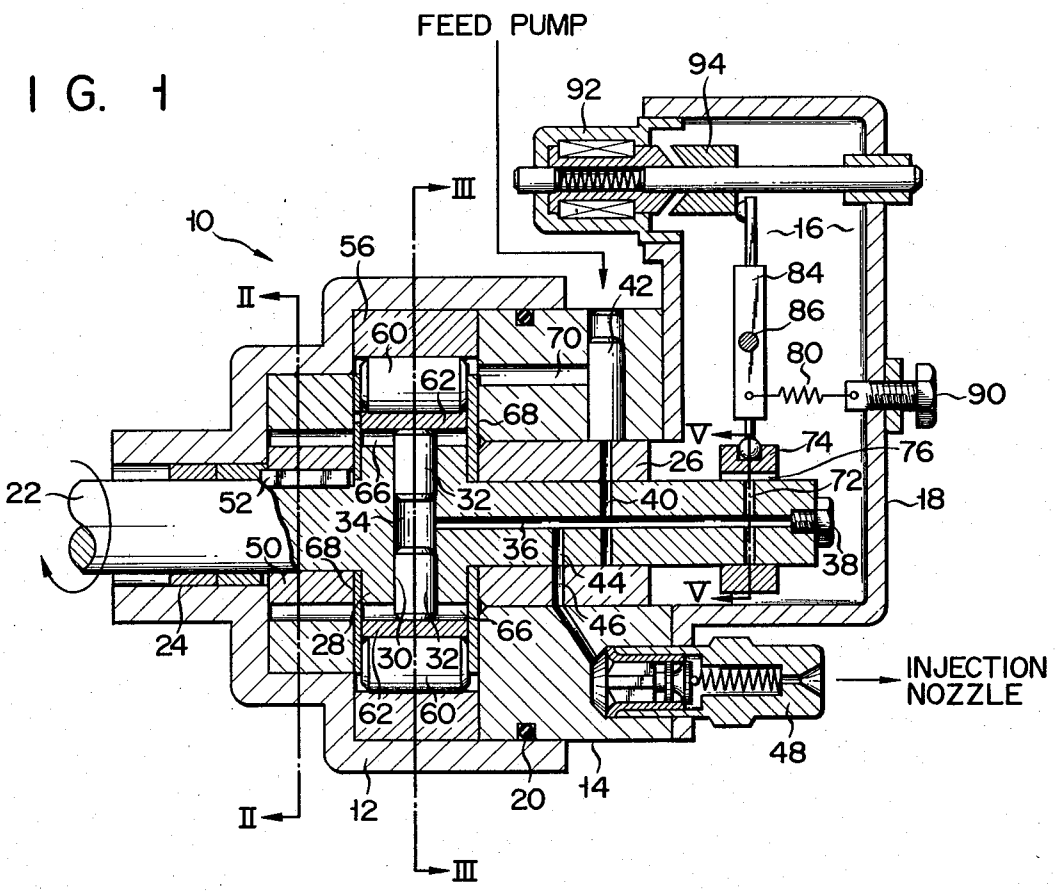
FIG. 1 is a vertical sectional view of a distributor type fuel-injection pump according to one embodiment of the present invention.

Referring to FIG. 1, there is shown a distributor type fuel-injection pump which is used in a four-cycle, four-cylinder internal combustion engine. The fuel-injection pump has a housing 10, which consists of a rear housing section 12, an intermediate housing section 14, and a front housing section 18 the inside of which is defined as a fuel return chamber 16. The fuel return chamber 16 is connected to a fuel tank (not shown) by means of a passage (not shown). The intermediate housing section 14 is fitted in the front end portion of the rear housing section 12 in an oiltight manner with the aid of an O-ring 20. The front housing section 18 is fixed to the front end face of the intermediate housing section 14 in an oiltight manner.

A rotor 22 is disposed in the housing 10. The front end portion of the rotor 22 extends into the front housing section 18, while its rear end portion extends outward from the rear housing section 12. The rotor 22 is rotatably supported by bearing sections 24 and 26 which are fitted in the rear and intermediate housing sections 12 and 14, respectively. The rear end of the rotor 22 is coupled to a crank shaft (not shown) of the engine by means of a transmission gear mechanism. The rotor 22 is rotated at a rotational frequency half that of the engine.

A flange portion 28 is formed integrally with that part of the rotor 22 which is located inside the rear housing section 12. The flange portion 28 of the rotor 22 has a cylindrical bore 30 extending in the radial direction of the flange portion 28. A pair of plungers 32 are slidably fitted in the cylindrical bore 30. Thus, a fuel pumping chamber 34 is defined in the cylindrical bore 30 between the opposed end faces of the two plungers 32. A fuel passage 36 is formed inside the rotor 22, extending along its axis. One end of the fuel passage 36 opens into the fuel pumping chamber 34, while the other end thereof opens to the front end face of the rotor 22. The front opening for the fuel passage 36 is closed by a plug 38 screwed into the front end portion of the rotor 22. Four radial holes 40 are formed at that portion of the rotor 22 covered with the bearing section 26, arranged at regular intervals around the axis of the rotor 22. One end of each radial holes 40 opens into the fuel passage 36, and the other end to the outer peripheral surface of the rotor 22. Each of the radial holes 40 can communicate with a fuel inlet passage 42 which is formed in the intermediate housing section 14 and the bearing section 26. In FIG. 1, one of the radial holes 40 is connected to the fuel inlet passage 42. A single distribution hole 44 is formed at that portion of the rotor 22 which is covered with the bearing section 26. One end of the distribution holes 44 opens into the fuel passage 36, and the other end to the outer peripheral surface of the rotor 22. The distribution hole 44 can communicate with each of four fuel outlet passages 46 which are formed in the intermediate housing section 14 and the bearing section 26. The respective openings of the fuel outlet passage 46 which open to the inner peripheral surface of the bearing section 26 are arranged at regular intervals around the axis of the rotor 22. As shown in FIG. 1, the fuel outlet passages 46 are connected to the injection nozzles (not shown) of the cylinders of the engine through delivery valves 48, individually. In FIG. 1, one of the fuel outlet passages 46 and one of the delivery valves 48 are shown. In FIG. 1, moreover, the distribution hole 44 is shown as communicating with one of the fuel outlet passages 46 for the ease of illustration. Actually, however, the distribution hole 44 communicates with none of the fuel outlet passages 46 when one of the radial holes 40 connects with the fuel inlet passage 42.

Figure 2:
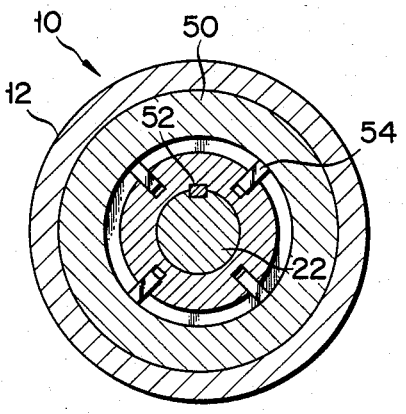
FIG. 2 is a sectional view taken along line II—II of FIG. 1.

In FIG. 1, a feed pump 50 is attached to that part of the rotor 22 just on the left of the flange portion 28 through the medium of a key 52. As shown in FIG. 2, the feed pump 50 is a vane-type pump having four vanes 54, and is rotated by the rotor 22. The feed pump 50 sucks up fuel from the fuel tank, and feeds the fuel inlet passage 42 through a fuel supply passage (not shown).

Figure 3:
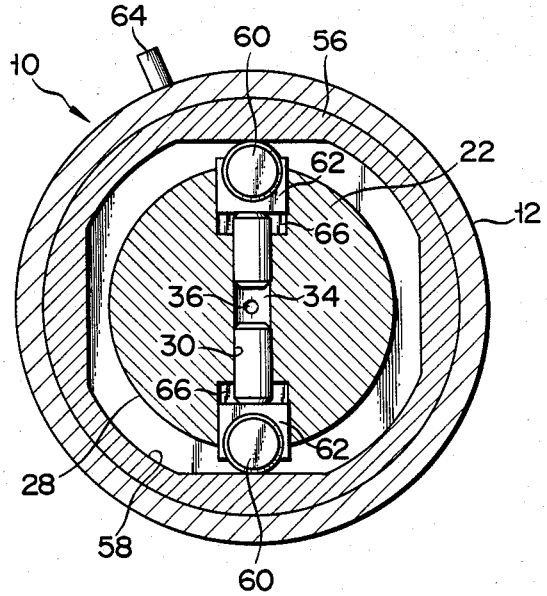
FIG. 3 is a sectional view taken along line III—III of FIG. 1.
Figure 4:
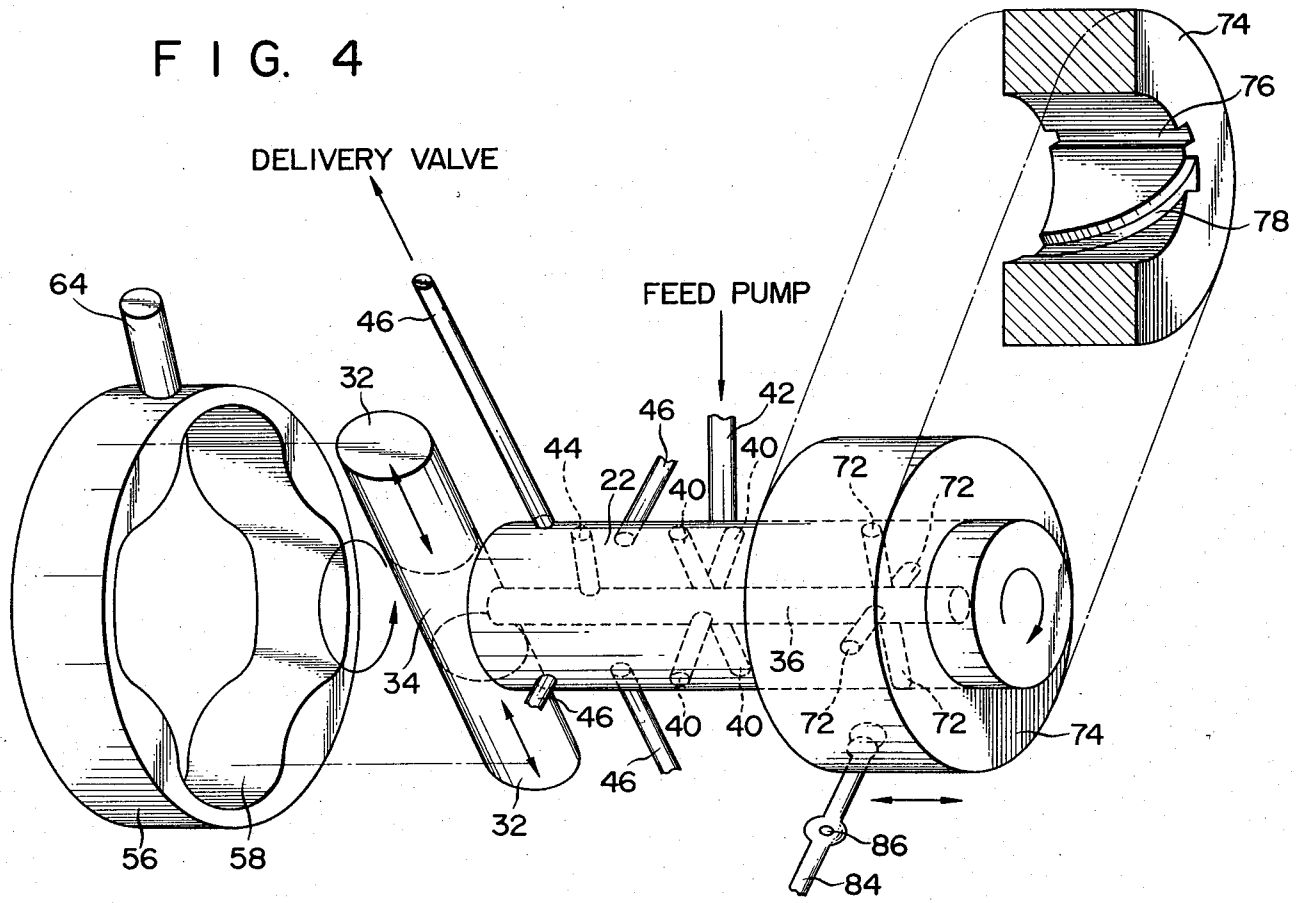
FIG. 4 is a perspective view schematically showing part of the fuel-injection pump.

A cam ring 56 coaxial with the rotor 22 is disposed in the rear housing section 12, located between the feed pump 50 and the intermediate housing section 14. The inner peripheral surface of the cam ring 56 is formed as a cam face 58, as shown in FIG. 3. The cam face 58 has a profile such that the cam face 58, in cooperation with cam rollers 60 and roller holding members 62 mentioned later, reciprocates the plungers 32 four times for each revolution of the rotor 22. As shown in FIGS. 3 and 4, a pin 64 protrudes from the outer peripheral surface of the cam ring 56. The cam ring 56 cam be turned around the axis of the rotor 22 for adjustment from the outside of the housing 10 by moving the pin 64. Two recessed portions 66 continuous with the cylindrical bore 30 are formed in the outer peripheral surface of the flange portion 28. The roller holding members 62 are fitted individually in recessed portions 66 so that they can slide in the radial direction of the rotor 22. The cam rollers 60 in rolling contact with the cam face 58 of the cam ring 56 are rotatably retained by their corresponding roller holding members 62. A guide plate 68 is put on each side face of the flange portion 28. The two guide plates 68 guide the roller holding members 62 in radial sliding. The space defined between the cam face 58 of the cam ring 56 and the outer peripheral surface of the flange portion 28 communicates with the fuel inlet passage 42 by means of a passage 70 which is formed in the intermediate housing section 14.

Four spill holes 72 formed of narrow round bores are radially formed in the front end portion of the rotor 22. One end of each spill holes 72 opens into the fuel passage 36, and the other end to the outer peripheral surface of the rotor 22. The ports of the spill holes 72 are arranged at regular intervals around the axis of the rotor 22. In FIG. 1, the spill holes 72 and the radial holes 40 are shown as if they are arranged in the same phase around the axis of the rotor 22, for convenience sake. Actually, however, there is a phase difference for a predetermined angle around the axis of the rotor 22 between the spill holes 72 and the radial holes 40.

Figure 5:
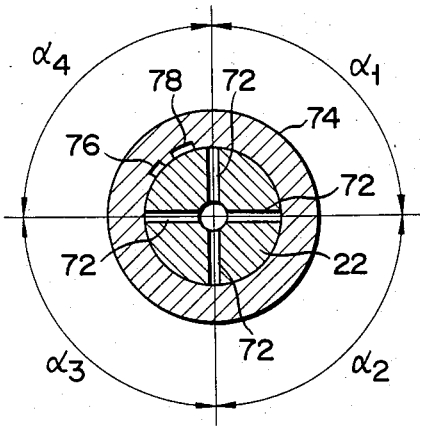
FIG. 5 is a sectional view taken along line V—V of FIG. 1.
Figure 7:
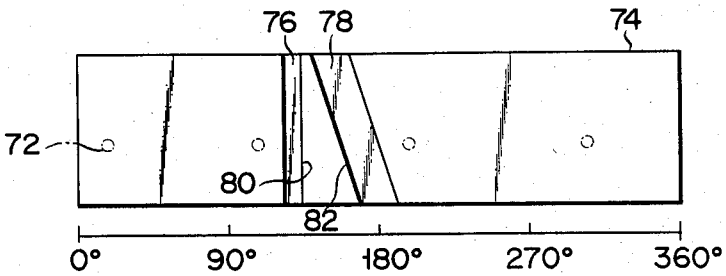
FIG. 7 is a development diagram showing the inner peripheral surface of a control sleeve.

A control sleeve 74 covering the ports of the spill holes 72 is fitted on the outer peripheral surface of the front end portion of the rotor 22 in an oiltight manner so that the control sleeve 74 can slide along the axis of the rotor 22. As shown in FIGS. 4 and 5, first and second spill grooves 76 and 78 are formed in close vicinity to each other in the inner peripheral surface of the control sleeve 74. The first spill groove 76 extends parallel to the axis of the rotor 22, and the two ends of the first spill groove 76 open individually to both side faces of the control sleeve 74. The second spill groove 78 extends diagonally or at an angle to the axis of the rotor 22. The two ends of the second spill grooves 78, like those of the first spill grooves 76, open individually to both side faces of the control sleeve 74. As shown in FIG. 7, therefore, the distance between respective facing edges 80 and 82 of the first and second spill grooves 76 and 78 gradually varies along the axis of the rotor 22. In this case, the distance between the edges 80 and 82 increases toward the intermediate housing section 14.

The control sleeve 74 is coupled with the lower end of a control lever 84 which extends upward in the front housing section 18. The control lever 84 is pivotally supported by a pin 86 at its middle portion so that it can rock around the pin 86. On end of a coil spring 88 for urging the control lever 84 to rock clockwise is coupled to the lower end portion of the control lever 84. The other end of the coil spring 88 is coupled to an adjust screw 90 which penetrates the front wall of the front housing section 18. The upper end of the control lever 84 engages an output shaft 94 of a conventional linear solenoid type actuator 92 which is disposed in the upper portion of the interior of the front housing section 18. Thus, the axial position of the control sleeve 74 on the rotor 22 can be adjusted by controlling the power supply to the actuator 92 to rock the control lever 84. The axial position of the control sleeve 74 may be controlled by using a conventional hydraulic servo type actuator in place of the linear solenoid type actuator 92.

The operation of the aforementioned distributor type fuel-injection pump will now be described.

When the engine is started to rotate the rotor 22, one of the radial holes 40 of the rotor 22 first communicates with the fuel inlet passage 42. At this moment, the plungers 32 of the rotor 22 come to their corresponding fuel suction portions of the cam face 58 of the cam ring 56. Thus, the fuel is fed from the feed pump 50 to the fuel pumping chamber 34 through the fuel inlet passage 42, the radial hole 40, and the fuel passage 36. As the fuel is fed in this manner, the plungers 32 move radially outward. In this fuel suction stroke, the distribution hole 44 communicates with none of the fuel outlet passage 46, and the spill holes 72 are closed by the control sleeve 74. Thereafter, as the rotor 22 rotates, the radial hole 40 is cut off from the fuel inlet passage 42, and the plungers 32 of the rotor 22 come to their corresponding fuel pressurization portions of the cam face 58 of the cam ring 56. Accordingly, the two plungers 32 are pushed radially inward by the cam surface 58 of the cam ring 56 through the medium of the rollers 60 and the roller retaining members 62. Thus, the fuel in the fuel pumping chamber 34 is pressurized. In the fuel pressurization stroke, the distribution hole 44 communicates with one of the fuel outlet passages 46. Thus, when the fuel in the fuel pumping chamber 34 is pressurized to a level higher than the predetermined pressure determined by the delivery valves 48 and the distribution hole 44 communicates with one of the fuel outlet passage 46 as the rotor 22 rotates, the pressurized fuel is delivery from the fuel pumping chamber 34 to the injection valve of a specified cylinder of the engine through the fuel passage 36, the distribution hole 44, the fuel outlet passage 46, and the delivery valve 48. Then, the delivered fuel is jetted from the injection valve. Such fuel pumping action is repeated four times while the rotor 22 makes one revolution. Thus, the pressurized fuel is successively distributed from the fuel injection pump to the injection valves of the individual engine cylinders.

There will now be described the functions and operations of the spill holes 72 and the control sleeve 74 which define the amount of fuel delivery from the fuel injection pump to the individual engine cylinders.

Figure 8A:
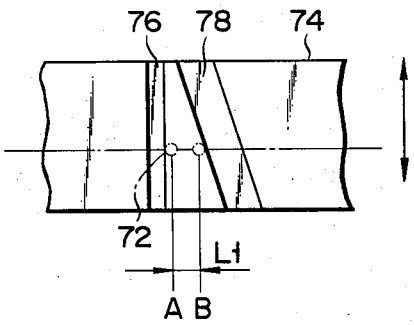
FIGS. 8*a* and 8*b* are partial development diagrams showing the inner peripheral surface of the control sleeve.
Figure 8B:
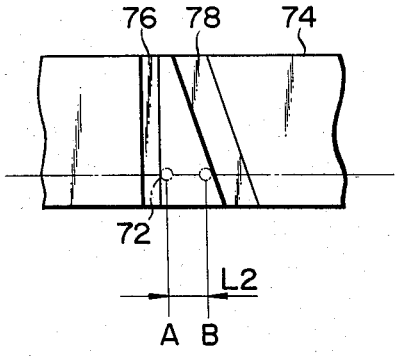

If the fuel in the fuel pumping chamber 34 is pressurized by the plungers 32, as described above, it is delivered from the fuel pumping chamber 34 through the fuel passage 36, the distribution hole 44, one of the fuel outlet passages 46, and its corresponding delivery valve 48. In the initial stage of the fuel pressurization stroke, however, one of the spill holes 72 communicates with the first spill groove 76. In the early stage of the fuel pressurization stroke, therefore, the fuel in the fuel pumping chamber 34 is let out therefrom to the fuel return chamber 16 in the front housing section 18 through the fuel passage 36, the spill hole 72, and the first spill groove 76. Thus, the fuel in the fuel pumping chamber 34 is prevented from being pressurized beyond the predetermined pressure level defined by the delivery valve 48. As a result, as shown in FIG. 8*a*, the fuel pressurization is actually started with the rotor 22 slightly rotated so that the port of the spill hole 72 comes to point A off the first spill groove 76. The fuel delivery is permitted on and after this point of time. Thereafter, when the rotor 22 is further rotated so that the spill hole 72 reaches point B where it communicates with the second spill groove 78, the fuel in the fuel pmmping chamber 34 is let out therefrom again to the fuel return chamber 16 through the fuel passage 36, the spill hole 72, and the second spill groove 78. Accordingly, the fuel in the fuel pumping chamber 34 is prevented from being pressurized beyond the predetermined pressure level defined by the delivery valve 48. As this point of time, the fuel delivery is ended. Thus, the actual stroke of the fuel delivery is defined by the distance L1 between the edges 80 and 82 of the first and second spill grooves 76 and 78 or between points A and B, the distance L1 meaning the closing time of the spill hole 72, as the rotor 22 rotates, as shown in FIG. 8*a*. In other words, the amount of fuel delivery is determined on the basis of the distance L1. The amount of fuel delivery thus defined by the first and second spill grooves 76 and 78 may be adjusted by moving the control sleeve 74 in the axial direction of the rotor 22 according to the operating condition of the engine. That is, the amount of fuel delivery may be adjusted by changing the distance between points A and B from L1 to L2 (L2>L1), as shown in FIG. 8*b*, for example.

According to one embodiment of the present invention as described in detail herein, the amount of fuel delivery is defined by the first and second spill grooves 76 and 78 which are formed on the inner peripheral surface of the control sleeve 74. Therefore, it is necessary to work the first and second spill grooves 76 and 78 with high accuracy for accurate control of the amount of fuel delivery. The first and second spill grooves 76 and 78, one of which is straight and the other slant, are simple in shape and have end openings on both side faces of the control sleeve 74. Accordingly, these grooves 76 and 78 can easily be worked with high accuracy. Thus, the amount of fuel delivery defined by the first and second spill grooves 76 and 78 can be controlled with high accuracy. The existence of the first and second spill grooves 76 and 78 never increases the space for fuel pressurization, including the fuel pumping chamber 34, the fuel passage 36, the radial holes 40, and the spill holes 72. Thus, the delivered fuel can be pressurized to high pressure.

Figure 6:
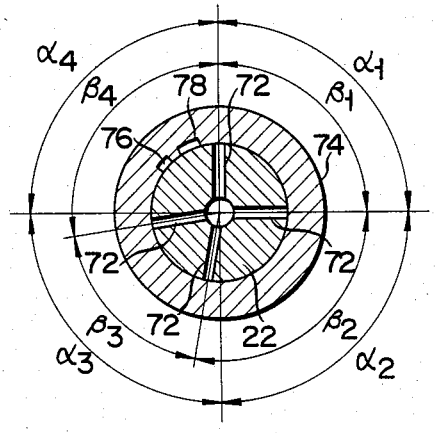
FIG. 6 is a sectional view similar to FIG. 5 showing a rotor whose spill holes are subject to working errors.

According to one embodiment of the invention, moreover, even if the spill holes 72 are subject to any working errors, the amount of fuel delivered to each engine cylinder can be made uniform. That is, although the spill holes 72 should be arranged at regular angular intervals $\alpha_1=\alpha_2=\alpha_3=\alpha_4$ (90°), around the axis of the rotor 22, as shown in FIG. 5, they may sometimes be arranged at irregular intervals, $\beta_3<\beta_1(=\alpha_1)<\beta_2=\beta_4$, around the axis of the rotor 22, as shown in FIG. 6. However, because the amount of fuel delivery is defined by the first and second spill grooves 76 and 78, therefore, even though the spill holes 72 are subject any working errors, the time that is required for each spill holes 72 to move from point A to point B as the rotor 22 rotates is uniform. Accordingly, the amount of fuel delivered from the fuel-injection pump to each engine cylinder is uniform. Thus, there are no difference in injection quantity between the individual engine cylinders.

What is claimed is:

1. A distributor type fuel-injection pump for distributing fuel to individual cylinders of an internal combustion engine, comprising:

a housing;

a rotor disposed in the housing and rotated by the engine, said rotor having therein a cylindrical bore extending at right angles to the axis of said rotor, a fuel passage opening into the cylindrical bore and extending along the axis of said rotor, and spill holes as many as the engine cylinders, opening into the fuel passage and having ports circumferentially arranged at regular intervals on the outer peripheral surface of said rotor;

a pair of plungers slidably fitted in the cylindrical bore of said rotor, opposed end faces of said plungers defining a fuel pumping chamber in the cylindrical bore;

fuel supply means for supplying fuel to said fuel pumping chamber;

cam means engaging the two plungers in said housing, said cam means being adapted to reciprocate both said plungers in the cylindrical bore as said rotor rotates, whereby a fuel pressurization process is repeated at a frequency equivalent to the number of the engine cylinders for each revolution of said rotor;

distribution/delivery means for distributing and delivering the fuel pressurized in the fuel pumping chamber to the individual engine cylinders through the fuel passage;

a control sleeve fitted on the outer peripheral surface of said rotor so as to be able to slide along the axis of said rotor, said control sleeve having on the inner peripheral surface thereof first and second spill grooves capable of communicating with each of the spill holes, at least one end of each the spill groove opening to the outer side face of said control sleeve, the circumferential distance between the first and second spill grooves varying along the axis of said rotor, whereby the opening and closing of the spill holes in each fuel pressurization process are controlled by the first and second spill grooves, so that the timing for the start of fuel delivery and the timing for the end of fuel delivery, which define the amount of fuel delivery, are determined in each fuel pressurization process; and adjusting means for moving said control sleeve along the axis of said rotor to adjust the amount of fuel delivery.

2. The fuel-injection pump according to claim 1, wherein the first and second spill grooves formed on the inner peripheral surface of said control sleeve extend parallel and at an angle to the axis of said rotor, respectively.

3. The fuel-injection pump according to claim 2, wherein the first and second spill grooves open at both ends to both side faces of said control sleeve.

4. The fuel-injection pump according to claim 1, wherein said fuel supply means includes a feed pump rotated by said rotor, and a fuel inlet passage connected to the feed pump and capable of communicating with the fuel passage, whereby the fuel delivered from the feed pump is supplied to the fuel passage through the fuel inlet passage.

5. The fuel-injection pump according to claim 4, wherein the feed pump is a vane pump.

6. The fuel-injection pump according to claim 1, wherein said cam means includes a cam ring coaxial with said rotor, the inner peripheral surface of the cam ring serving as a cam face, and a pin protrudes from the outer peripheral surface of the cam ring, whereby the cam ring can directly turned around the axis of said rotor for external adjustment.

7. The fuel-injection pump according to claim 1, wherein the spill holes are narrow round bores.

8. The fuel-injection pump according to claim 1, wherein said adjusting means includes a linear solenoid type actuator which serves to move said control sleeve along the axis of said rotor, whereby the axial position of said control sleeve on said rotor is controlled.

* * * * *